US010468164B2

(12) United States Patent
Heinemann et al.

(10) Patent No.: US 10,468,164 B2
(45) Date of Patent: Nov. 5, 2019

(54) ELECTRICALLY CONDUCTIVE SHAPED BODY WITH A POSITIVE TEMPERATURE COEFFICIENT

(71) Applicant: THÜRINGISCHES INSTITUT FÜR TEXTIL-UND KUNSTSTOFF-FORSCHUNG E. V., Rudolstadt (DE)

(72) Inventors: Klaus Heinemann, Rudolstadt (DE); Ralf-Uwe Bauer, Rudolstadt (DE); Thomas Welzel, Jena (DE); Mario Schrödner, Rudolstadt (DE); Frank Schubert, Jena (DE); Sabine Riede, Rudolstadt (DE)

(73) Assignee: THUERINGISCHES INSTITUT FUER TEXTIL-UND KUNSTSTOFF-FORSCHUNG E.V., Rudolstadt (DE)

( * ) Notice: Subject to any disclaimer, the term of this patent is extended or adjusted under 35 U.S.C. 154(b) by 0 days.

(21) Appl. No.: 16/312,147

(22) PCT Filed: Jun. 22, 2017

(86) PCT No.: PCT/EP2017/065461
§ 371 (c)(1),
(2) Date: Dec. 20, 2018

(87) PCT Pub. No.: WO2017/220747
PCT Pub. Date: Dec. 28, 2017

(65) Prior Publication Data

US 2019/0237224 A1 Aug. 1, 2019

(30) Foreign Application Priority Data

Jun. 22, 2016 (DE) ..... 10 2016 111 433

(51) Int. Cl.
*H01C 7/02* (2006.01)
*H01C 17/00* (2006.01)
*H01C 17/065* (2006.01)

(52) U.S. Cl.
CPC ..... *H01C 7/028* (2013.01); *H01C 17/006* (2013.01); *H01C 17/06586* (2013.01)

(58) Field of Classification Search
CPC . H01C 7/028; H01C 17/006; H01C 17/06586
See application file for complete search history.

(56) References Cited

U.S. PATENT DOCUMENTS 6,607,679 B2 8/2003 Handa et al.
8,558,655 B1 * 10/2013 Chen ..... H01C 7/027 338/13

(Continued)

FOREIGN PATENT DOCUMENTS

| | | | |
|---|---|---|---|
| JP | 2012-181956 | A | 9/2012 |
| WO | 2006/006771 | A1 | 1/2006 |
| WO | 2006115569 | A2 | 11/2006 |
| WO | 2016012762 | A1 | 1/2016 |

OTHER PUBLICATIONS

M. Bischoff et al., "Herstellung eines Black-Compounds aus PE/Leitruß, zur Anwendung für aufheizbare Fasern" [Production of a black compound material form PE/conductive carbon black for use for heatable fibers] in Technische Textilien, Feb. 2016, pp. 50-52.

*Primary Examiner* — Kyung S Lee
(74) *Attorney, Agent, or Firm* — ProPat, L.L.C.

(57) ABSTRACT

The invention describes electrically conductive shaped bodies with an inherent positive temperature coefficient (PTC), produced from a composition which contains at least one organic matrix polymer (compound component A), at least one submicroscale or nanoscale, electrically conductive additive (compound component B) and at least one phase-change material with a phase-transition temperature in the range from −42° C. to +150° C. (compound component D).

(Continued)

The phase-change material is incorporated into an organic network (compound component C). The electrically conductive shaped body with an inherent PTC effect is, in particular, a filament, a fibre, a spun-bonded web, a foam, a film, a foil or an injection-moulded article. The switching point for the PTC behavior is dependent on the type and also the phase-conversion temperature of the phase-change material. By way of example, a self-regulating surface heater in the form of a film, foil and/or textile can be realized in this way.

22 Claims, 3 Drawing Sheets

(56) References Cited

U.S. PATENT DOCUMENTS

| | | | | |
|---|---|---|---|---|
| 8,728,354 | B2 * | 5/2014 | Bandyopadhyay | C08K 3/08 219/217 |
| 8,968,605 | B2 * | 3/2015 | Yue | C08L 23/0853 252/511 |
| 9,249,342 | B2 * | 2/2016 | Zaffaroni | C08K 3/04 |
| 9,349,510 | B2 * | 5/2016 | Lo | H01C 17/06586 |
| 9,773,589 | B1 * | 9/2017 | Chen | H01C 7/028 |
| 10,147,525 | B1 * | 12/2018 | Chen | H01C 7/028 |
| 2002/0093007 | A1 | 7/2002 | Handa et al. | |
| 2013/0002395 | A1 | 1/2013 | Luizi et al. | |

* cited by examiner

ELECTRICALLY CONDUCTIVE SHAPED BODY WITH A POSITIVE TEMPERATURE COEFFICIENT

CROSS-REFERENCE TO RELATED APPLICATIONS

This application is being filed under 35 U.S.C. §371 as a National Stage Application of pending International Application No. PCT/EP2017/065461 filed Jun. 22, 2017, which claims priority to the following parent application: German Patent Application No. 10 2016 111 433.2, filed Jun. 22, 2016. Both International Application No. PCT/EP2017/065461 and German Patent Application No. 10 2016 111 433.2 are hereby incorporated by reference herein in their entirety.

FIELD OF THE INVENTION

The present invention relates to electrically conductive moldings made of an electrically conductive polymer composition which has inherent positive temperature coefficient (PTC) and which comprises at least one organic matrix polymer, submicro- or nanoscale electrically conductive particles and at least one phase-change material with a phase transition temperature in the range from −42° C. to +150° C. The moldings are produced by the injection-molding process or are in particular electrically conductive monofilaments, multifilaments, fibers, nonwoven fabrics, foams or films or foils which can by way of example be used in automobile heating systems or heating blankets or industrial textiles, and are self-regulating in respect of current.

BACKGROUND OF THE INVENTION

PTC resistances or PTC thermistors have a positive temperature coefficient (PTC) of electrical resistivity and are electrically conductive materials which have better electrical conductivity at low temperatures than at higher temperatures. Within a relatively narrow temperature range, the electrical resistivity rises markedly with increasing temperature. Materials of this type can be used for heating elements, current-limiting switches or sensors. Known PTC polymer compositions have low resistance at room temperature, i.e. at about 24° C., thus allowing electrical current to flow. When temperature is increased greatly, up to the vicinity of the melting point, resistance increases to a value that is from $10^4$ to $10^5$ times the value at room temperature (24° C).

Polymeric PTC compositions consist of a mixture of organic polymers, in particular crystalline and semi-crystalline polymers, with electrically conductive additives. The PTC effect in the prior art is mostly based on structural alteration of crystalline polymer domains during temperature increase to give amorphous or less crystalline domains. Specific polymer mixtures comprise not only the thermoplastic polymers but also thermoelastic polymers, resins and other elastomers. An example of this is described in WO2006115569.

Polymer compositions of the above type have the disadvantage that the PTC effect is restricted to a switching behavior based on structural alteration of the polymers used as main component. PTC intensity, i.e. the change of resistance, is moreover very highly dependent on the polymer or polymer blend used.

The prior art also discloses liquid polymer dispersions with PTC effect which are provided for coatings or lacquer systems. The PTC effect in these liquid polymer dispersions is based on an additive, for example paraffin or polyethylene glycol (PEG), see for example WO 2006/006771.

JP 2012-181956 A discloses an aqueous paint dispersion which comprises an acrylate copolymer, a crystalline, heat-curing resin, paraffin, carbon black and graphite as electrically conductive material, and also a crosslinking agent. The heat-curing resin is preferably a polyethylene glycol and the crosslinking agent is preferably a polyisocyanate. The paint is applied to a surface and heated for from 30 to 60 min to a temperature of from 130 to 200° C. A coating is thus produced which has PTC effect and which can serve as planar heating element.

Impregnation compositions and coating compositions of the above type are problematic because uncontrolled loss of solvent by evaporation often occurs during application, with formation of craters and blisters that are visible to a greater or lesser extent in the coating. If pretreatment of the substrate to be coated is inadequate, adhesion of the coating is often defective because of excessively low or excessively high surface energy, or else unsuitable surface structure. This results in break-away and flaking of the functional layer and, associated therewith, considerable impairment of electrical conductivity and of the PTC effect. Defective application of the impregnation composition or coating composition, inadequate drying and/or crosslinking, excessively high drying temperatures or hardening temperatures, excessively long drying times or hardening times, or an excessive dose of crosslinking radiation, have a direct adverse effect on the durability and functionality of the coating. This is true in particular, but not only, in the coating of textiles. Another phenomenon often encountered, either to a relatively small degree or over a large area, is "bleeding" of paraffin from said impregnation systems and coatings, causing failure of same after a short service time.

The article by M. Bischoff et al. "Herstellung eines Black-Compounds aus PE/LeitruB zur Anwendung für aufheizbare Fasern" [Production of a black compound material form PE/conductive carbon black for use for heatable fibers] in Technische Textilien 2/2016, pp. 50-52 relates to the electrical conductivity of, and the generation of heat by, a compound material made of 90% of polyethylene and 10% of conductive carbon black.

U.S. Pat. No 6,607,679 B2 describes an organic PTC thermistor which comprises a low-molecular-weight organic compound, electrically conductive metal particles, and a matrix made of at least two polymers, where the surface of each conductive particle has from 10 to 500 conical projections. About 10 to 1000 of said particles can have been bonded in the form of a network to give a secondary particle. The individual particles preferably consist of nickel. Their average diameter is about 3 to 7 μm. At least one of the two polymers in the matrix must be a thermoplastic elastomer. The thermoplastic elastomer ensures reproducibility of the electrical properties of the PTC composite material, in particular low electrical resistance at room temperature and large resistance change at elevated temperatures, even when the low-molecular-weight organic compound melts. The low-molecular-weight organic compound is preferably a paraffin wax with melting point from 40 to 200° C. The matrix can comprise other electrically conductive particles, for example made of carbon black, graphite, carbon fibers, tungsten carbide, titanium nitride, titanium carbide or titanium boride, zirconium nitride or molybdenum silicide. The PTC thermistor can be produced via pressing at elevated temperature (for example at 150° C.) or via application of a mixture which additionally comprises a solvent such as toluene to a carrier, for example a nickel foil, and then heating and crosslinking of the resultant coating.

WO 2006/006771 A1 describes an aqueous electrically conductive polymer composition which has a positive temperature coefficient (PTC). It comprises a water-soluble polymer, a paraffin, and also electrically conductive carbon black. The water-soluble polymer is preferably polyethylene glycol. The aqueous composition can be used to produce coating which can be used as flat heating element.

The materials disclosed in the prior art for the production of electrically conductive polymer moldings with positive temperature coefficient (PTC) are based on aqueous dispersions and are unsuitable for processes involving melting, for example extrusion, melt spinning and injection molding. Compositions for electrically conductive polymer moldings with PTC for the purposes of this invention comprise, as substantial constituents, a matrix polymer, a conductivity additive and a phase-change material. The processing temperature in processes involving melting is usually in the range from 100° C. to above 400° C., in particular in the range from 105° C. to 450° C. At these temperatures, the phase-change material is liquid and has low viscosity. In contrast, the viscosity of the plastified matrix polymer is substantially higher, sometimes higher by several orders of magnitude. Even when there is good miscibility of matrix polymer and phase-change material, for example polyethylene and paraffin, the phase-change material takes the form of a phase intercalated in the matrix polymer. When the high mechanical load or high shear stress, or pressure, at extruder dies or injection-molding nozzles is combined with a temperature well above the melting range of the phase-change material, the result is that the intercalated low-viscosity phase-change material is forced out of the matrix polymer and to some extent lost into the environment. This effect can moreover be amplified in particular temperature-shear stress/pressure ranges by deformation-induced phase segregation or demixing. Loss of phase-change material is particularly large when the dimension of the extruded molding, for example a fiber or foil, is small in at least one spatial direction: less than 1000 μm. For the purposes of the present invention, the term "bleed-out" is also used for the loss of phase-change material.

During the intended use of the PCT molding, the phase-change material is subsequently heated and liquefied, sometimes with exposure to considerable mechanical load. "Bleeding" of the phase-change material therefore also occurs during the use of the PTC molding.

SUMMARY OF ADVANTAGEOUS EMBODIMENTS OF THE INVENTION

The moldings of the present invention are in particular intended for electrically heatable sheet materials, for example foils, textile fibers and/or nonwoven fabrics. The heat output P generated in a conductor with resistance R through which electrical current flows is in essence equal to the power output calculated from Ohm's law, calculated from the relationship $P=U\cdot I=U^2/R$, where U is the voltage and I is the current. Heat output P from a few watts up to about 2000 W is achievable, depending on the application and on the size of the molding or electrically heatable sheet material of the invention. Heat output is subject to an upward restriction imposed by the available voltage U and the resistance R of the molding. The available voltage for stationary or portable applications, for example household applications, hospital applications, or automobile applications, is in the range from 1.5 to 240 V. For a given voltage U and a desired heat output P, the resistance R is calculated from the relationship $R=U^2/P$. For a heat output of by way of example P300 W with a voltage U=240 V, the resistance R is $(240\ V)^2/300\ W=192\ \Omega$. Similarly, for a heat output P=1 W with a voltage U=1 V the required resistance R is $(1\ V)^2/1\ W=1\ \Omega$. Accordingly, the electrical resistance R of the molding is intended to be in the range from 1 to 200 Ω.

The resistance R of a body through which electrical current flows depends on the length L of the distance or path traveled by the current and on the cross-sectional area A of the body in a plane perpendicular to the path of the current in accordance with the relationship $R=\rho\cdot L/A$, where ρ is the electrical resistivity of the body in units of $\Omega\cdot mm^2/m$, or often Ω·m or Ω·cm. The resistivity is constant for a given material, irrespective of the geometry of the body. This may be illustrated by considering a foil with thickness T=200 μm, a distance L=1000 mm traveled by the current, and width W=800 mm. The resistance R of the foil over the distance L traveled by the current would be R=100 Ω. The resultant value for the resistivity ρ of the foil material is:

$$\rho=R\cdot A/L=R\cdot T\cdot W/L=100\ \Omega\cdot 200\ \mu m\cdot 800\ mm/1000\ mm=16\ 000\ \Omega\cdot\mu m=0.016\ \Omega\cdot m$$

The resistivity ρ of a conductive molding is determined via the content and electrical conductivity of the conductivity additive. The resistivity required for the abovementioned heating applications can in principle be achieved via a correspondingly high content of conductivity additive. However, the costs associated therewith, and/or the impairment of mechanical properties of the molding, are a considerable obstacle for many applications.

In order to provide a prescribed electrical conductivity or electrical resistivity to the polymer molding of the invention, the conductivity additive in the polymer matrix must develop a conductive network with suitable morphology. At the same time, in order to avoid excessive impairment of the mechanical properties of the molding, for example elongation at break, the proportion of the conductivity additive is not permitted to exceed a certain value.

The present invention was based on the object of overcoming the problems existing hitherto and providing a composition from which it is possible to produce electrically conductive moldings with an inherent PTC effect. The anhydrous composition is intended to be amenable to processing to give moldings by conventional processes involving melting, for example extrusion, melt spinning or injection molding.

It has been found possible here to produce such moldings in a process involving melting if submicro- or nanoscale electrically conductive particles, together with a phase-change material which is advantageously combined in polymer network structures of a copolymer to give a masterbatch, and also with other compound-material components, form a thermoplastifiable mixture.

DETAILED DESCRIPTION OF ADVANTAGEOUS EMBODIMENTS OF THE INVENTION

Figure 1A:
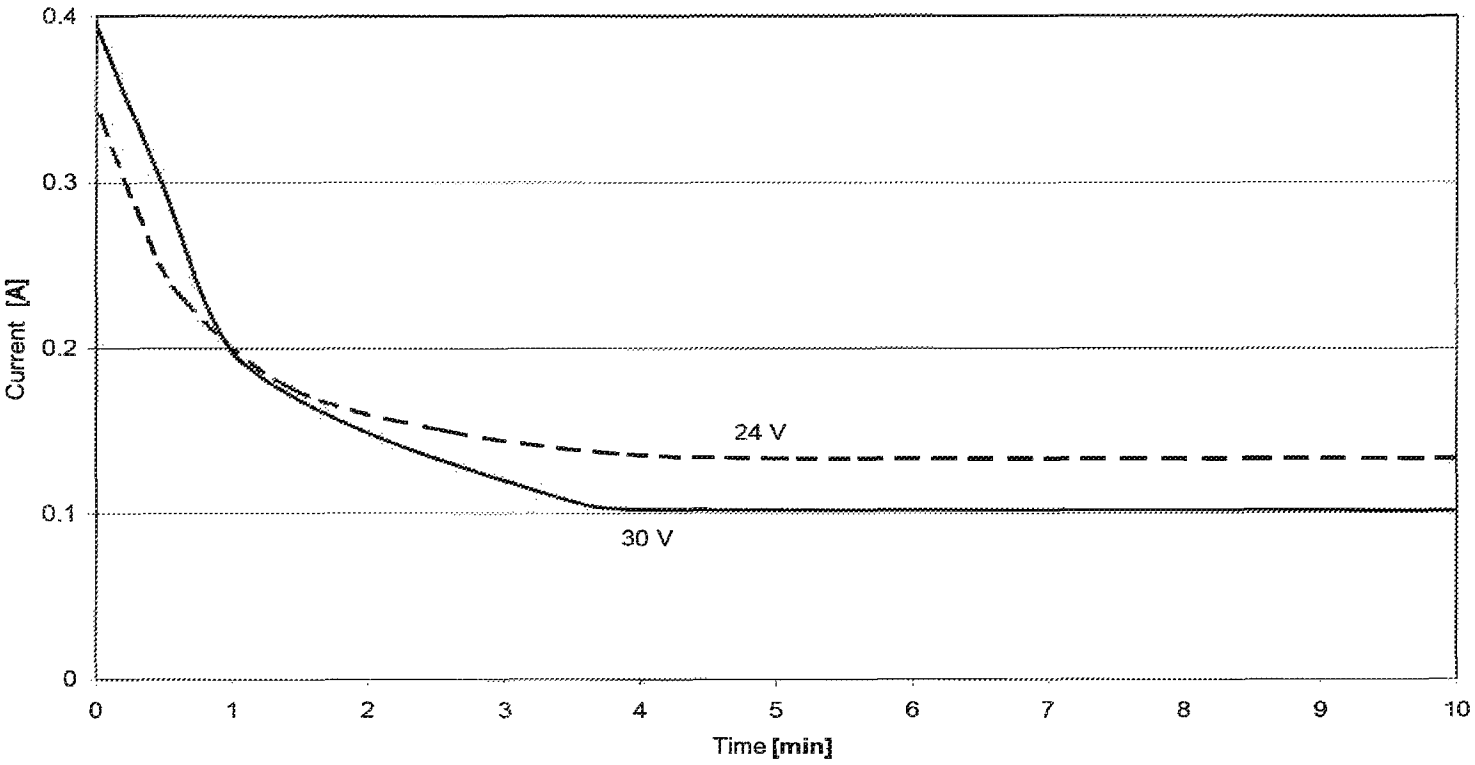
FIG. 1A graphically illustrates electrical current as a function of time in an exemplary heating textile comprising PTC filament yarn.

The object is accordingly achieved via a molding made of an electrically conductive composition which has inherent positive temperature coefficient and which comprises at least one organic matrix polymer (compound material component A), submicro- or nanoscale electrically conductive particles (compound material component B) and at least one phase-change material with a phase-transition temperature in the range from −42° C. to +150° C. (compound material component D), and also optionally stabilizers, modifiers, dispersing agents and processing aids, where the melting range of the polymer composition is within the range from 100 to 450° C., characterized in that the phase-change material has been bound into an organic network made of at least one copolymer based on at least two different ethylenically unsaturated monomers (compound material component C), and also in that the temperature range for the onset of the PTC effect is set by way of the nature, and the phase-transition temperature, of the phase-change material, and the PTC effect results from an increase in the volume of the phase-change material as a consequence of the temperature increase, and when the PTC takes effect the electrically conductive moldings do not experience any changes in the morphology of the crystalline structures and do not melt. There is no impairment of the service properties of the electrically conductive moldings. A temperature increase of 60° C. here leads to an increase of 50% or more in the PTC intensity. It is preferable that said temperature increase leads to an increase of at least 75% in the PTC intensity, particularly at least 100%, as also revealed in the examples below. The temperature change can be repeated as often as desired, without any resultant change in the morphology in the crystalline regions of the molding.

The phase-change material can be in undiluted form or in the form of a masterbatch when it is mixed with the other components during the production of the electrically conductive composition.

In a preferred embodiment, the composition consists of from 10 to 90% by weight of matrix polymer, from 0.1 to 30% by weight of electrically conductive particles, from 2 to 50% by weight of phase-change material with a phase-transition temperature in the range from −42° C. to 150° C., from 0 to 10° by weight of processing aids, and also stabilizers, modifiers and dispersing agents, based on the total weight of the composition, where the sum of the proportions by weight of all of the constituents of the composition is 100% by weight, and the melting range of the composition is within the range from 100° C. to 450° C.

In preferred embodiments the composition is crosslinkable;

the melting range of the matrix polymer is within the range from 100° C. to 450° C.;

the melting range of the matrix polymer in association with the processing aids and/or stabilizers, modifiers and dispersing agents is within the range from 100° C. to 450° C.;

the melting range of the phase-change material is below the melting range of the matrix polymer by at least 10° C., preferably at least 20° C., particularly preferably at least 30° C.;

the matrix polymer consists of one or more polymers selected from ethylene homopolymers, ethylene copolymers, propylene homopolymers, propylene copolymers, homo- and copolyamides, homo- and copolyesters, acrylate homo- and copolymers, styrene homo- and copolymers, polyvinylidene fluoride and mixtures thereof;

the matrix polymer comprises crystalline, semicrystalline and/or amorphous polymers and at least one polymer from the group of the polyethylenes (PE), for example LDPE, LLDPE, HDPE and/or the respective copolymers, from the group of the atactic, syndiotactic and/or isotactic polypropylenes (PP) and/or the respective copolymers, from the group of the polyamides (PA), and among these in particular PA 11, PA 12, the PA 6.66 copolymers, the PA 6.10 copolymers, the PA 6.12 copolymers, PA 6 or PA 6.6, from the group of the polyesters (PES) having aliphatic constituents, having aliphatic constituents in combination with cycloaliphatic constituents and/or having aliphatic constituents in combination with aromatic constituents, and among these in particular polybutylene terephthalates (PBT), polytrimethylene terephthalates (PTT) and polyethylene terephthalates (PET), and also of the chemically modified polyesters, and among these in particular glycol-modified polyethylene terephthalates (PETG), from the group of the polyvinylidene fluorides (PVDF) and of the respective copolymers, from the group of the crosslinkable copolymers, and also from the group of the mixtures or blends of said polymers and/or copolymers;

the electrically conductive material consists of micro- or nanoscale particles, flakes, needles, tubes, platelets, spheroids or fibers made of carbon black, of graphite, of expanded graphite, of graphene, of metal or of metal alloys; of electrically conductive polymers; of single-wall or multiwall, open or closed, unfilled or filled carbon nanotubes (CNT); of metal-filled carbon nanotubes or of mixtures of the above materials;

the electrically conductive material consists of a carrier polymer and, dispersed therein, micro- or nanoscale particles, flakes, needles, tubes, platelets, spheroids or fibers made of carbon black, of graphite, of expanded graphite, of graphene, of metal or of metal alloys; of electrically conductive polymers; of single-wall or multiwall, open or closed, unfilled or filled carbon nanotubes (CNT); of metal-filled carbon nanotubes or of mixtures of the above materials;

the electrically conductive material consists of an electrically conductive carrier polymer and, dispersed therein, micro- or nanoscale particles, flocks or fibers made of carbon black, graphene, metal, metal alloys and/or carbon nanotubes (CNT);

the electrically conductive material comprises micro- or nanoscale particles, micro- or nanoscale fibers, micro- or nanoscale needles, micro- or nanoscale tubes, micro- or nanoscale platelets, micro- or nanoscale spheroids or a mixture thereof;

the electrically conductive material comprises carbon black, conductive carbon blacks, graphites, expanded graphites, single-wall or multiwall carbon nanotubes (CNT), open or closed carbon nanotubes, unfilled or metal-filled carbon nanotubes, graphenes, carbon fibers, metal particles, in particular metal platelets of the metals Ni, Ag, W, Mo, Au, Pt, Fe, Al, Cu, Ta, Zn, Co, Cr, Ti, Sn or an alloy thereof;

the electrically conductive material comprises silver-decorative carbon nanotubes (CNT);

the iodine adsorption of the electrically conductive material made of carbon black is from 400 to 1800 mg/g determined in accordance with ASTM D1510-16;

the oil absorption (dibutyl phthalate absorption) of the electrically conductive material made of carbon black is from 200 to 500 $cm^3$/100 g determined in accordance with ASTM D2414-16;

the electrically conductive material consists of carbon black, and its oil absorption (dibutyl phthalate absorption) after four compressions by a pressure of 165 MPa is from 160 to 240 $cm^3$/100 g determined in accordance with ASTM D3493-16;

the electrically conductive material consists of carbon black, and its void volume is from 100 to 250 $cm^3$/100 g determined in accordance with ASTM D6086-09a for a geometric-mean pressure $P_{GM}$ of 50 MPa, where $P_{GM}$ is calculated from the pressure $P_0$ exerted on an upper face side of a cylindrical carbon black sample and the pressure $P_1$ measured at a lower face side of the cylindrical carbon black sample in accordance with the relationship $P_{GM}=\sqrt{P_0 \cdot P_1}$;

the electrically conductive material consists of carbon black, where the mean equivalent diameter of the primary carbon black particles determined in accordance with ASTM D3849-14a is from 8 to 40 nm, from 8 to 30 nm, from 8 to 20 nm or from 8 to 16 nm;

the electrically conductive material consists of carbon black, where the carbon black comprises aggregates with a mean equivalent diameter determined in accordance with ASTM D3849-14a of from 100 to 1000 nm, from 100 to 300 nm or from 100 to 200 nm;

the phase-transition temperature of the phase-change material is in the range from −42° to 150° C., from −42° C. to 96° C., from 20 to 80° C., from 20 to 60° C. from 20 to 50° C., from 30 to 80° C., from 30 to 60° C. or from 30 to 50° C.;

the phase-change material consists of one or more substances which are preferably low-molecular-weight hydrocarbons which have from 10 to 25 carbon atoms in a molecular chain; of low-molecular-weight, native or synthetic, linear or branched polymers; of ionic liquids; of native or synthetic paraffins; of native or synthetic waxes; of native or synthetic fatty alcohols, of native or synthetic wax alcohols; or a mixture of two or more of the materials mentioned;

the phase-change material is a natural or synthetic paraffin, a polyalkylene glycol (=polyalkylene oxide), preferably polyethylene glycol (=polyethylene oxide), a polyester alcohol, a highly crystalline polyethylene wax or a mixture thereof;

the phase-change material consists of one or more ionic liquids;

the phase-change material consists of a mixture of one or more ionic liquids with one or more substances selected from the group comprising natural and synthetic paraffins, polyalkylene glycols (=polyalkylene oxides), preferably polyethylene glycols (=polyethylene oxides), polyester alcohols, highly crystalline polyethylene waxes;

the phase-change material comprises one or more stabilizers selected from functionalized polymers, functionalized micro- or nanoscale silica, functionalized micro- or nanoscale minerals with layer structure, n-octadecylamine-functionalized functionalized carbon nanotubes and mixtures thereof;

the phase-change material comprises one or more dispersing agents selected from ethylene-vinyl acetate copolymer, polyethylene-poly(ethylene-propylene), poly(ethylene-butene), poly(maleic anhydride amide-co-α-olefin) and mixtures thereof;

the phase-change material comprises a stabilizer and/or a dispersing agent selected from:

terblock polymers, for example styrene-butadiene-styrene (SBS) and styrene-isoprene-styrene (SIS);

tetrablock polymers, for example styrene-ethylene-butylene-styrene (SEBS), styrene-ethylene-propylene-styrene (SEPS), styrene-poly(isoprene-butadiene)-styrene (SIBS);

acrylonitrile-butadiene-styrene (ABS);

terblock polymers, in particular ethylene-propylene-diene (EPDM);

terpolymers, in particular ethylene-vinyl acetate-vinyl alcohol (EVAVOH);

ethylene-maleic anhydride (EMSA), ethylene-acrylate-maleic anhydride (EAMSA), methyl acrylate-maleic anhydride, ethyl acrylate-maleic anhydride, propyl acrylate-maleic anhydride, butyl acrylate-maleic anhydride;

ethylene-glycidyl methacrylate (EGMA), methylglycidyl methacrylate, ethylglycidyl methacrylate, propylglycidyl methacrylate, butylglycidyl methacrylate;

ethylene-acrylate-glycidyl methacrylate (EAGMA), methyl acrylate-glycidyl methacrylate, ethyl acrylate-glycidyl methacrylate, propyl acrylate-glycidyl methacrylate, butyl acrylate-glycidyl methacrylate;

ethylene-vinyl acetate (EVA) , ethylene-vinyl alcohol (EVOH), ethylene-acrylate (EA) , ethylene--methyl acrylate (EMA) , ethylene-ethyl acrylate (EEA) , ethylene-propyl acrylate (EPA), ethylene-butyl acrylate (ESA);

homo- and copolymers and graft copolymers of polyethylene (PE), in particular LDPE, LLDPE, HDPE;

homo- and copolymers and graft copolymers of propylene (PP), in particular atactic, syndiotactic and isotactic polypropylenes;

amorphous polymers, for example cycloolefin copolymers (COC), polymethyl methacrylate (PMMA), amorphous polypropylene, amorphous polyamides, amorphous polyesters and polycarbonates (PC);

the proportion by weight of a matrix polymer is in the range from 10 to 30% by weight, from 20 to 40% by weight, from 30 to 50% by weight, from 40 to 60% by weight, from 50 to 70% by weight, from 60 to 80% by weight or from 70 to 90% by weight, based on the total weight of the composition, where the sum of the proportions by weight of all of the individual constituents of the composition is 100% by weight;

the proportion by weight of the electrically conductive material is in the range from 0.1 to 4% by weight, from 2 to 6% by weight, from 4 to 8% by weight, from 6 to 10% by weight, from 8 to 12% by weight, from 10 to 14% by weight, from 12 to 16% by weight, from 14 to 18% by weight, from 16 to 20% by weight, from 18 to 22% by weight, from 20 to 24% by weight, from 22 to 26% by weight, from 24 to 28% by weight or from 26 to 30% by weight, based on the total weight of the composition, where the sum of the percentages by weight of all of the individual constituents of the composition is 100% by weight;

the electrically conductive material consists of carbon black, and the proportion by weight of the electrically conductive additive is in the range from 18 to 30% by weight, from 20 to 24% by weight, from 24 to 28% by weight or from 26 to 30% by weight, based on the total weight of the composition, where the sum of the percentages by weight of all of the individual constituents of the composition is 100% by weight;

electrically conductive material consists of carbon nanotubes (CNT), and the proportion by weight of the electrically conductive additive is in the range from 0.1 to 4% by weight, based on the total weight of the composition, where the sum of the percentages by weight of all of the individual constituents of the composition is 100% by weight;

the electrically conductive material consists of carbon black and of carbon nanotubes (CNT) , and the proportion by weight of the electrically conductive additive is in the range from 0.1 to 4% by weight, based on the total weight of the composition, where the sum of the percentages by weight of all of the individual constituents of the composition is 100% by weight;

the proportion by weight of the phase-change material is in the range from 2 to 6% by weight, from 4 to 8% by weight, from 6 to 10% by weight, from 8 to 16% by weight, from 12 to 20% by weight, from 16 to 24% by weight, from 20 to 28% by weight, from 24 to 32% by weight, from 28 to 36% by weight, from 32 to 40% by weight, from 36 to 44% by weight, from 40 to 43% by weight or from 42 to 50% by weight, based on the total weight of the composition, where the sum of all of the percentages by weight of the individual constituents of the composition is 100% by weight;

and the composition optionally comprises one or more processing aids and/or dispersing agents and/or stabilizers and/or modifiers selected from lubricants, epoxidized soya oil, heat stabilizers, high-molecular-weight polymers, plasticizers, antiblocking agents, dyes, color pigments, fungicides, UV stabilizers, fire-protection agents and fragrances.

The molding of the invention is preferably a monofilament, multifilament, fiber, nonwoven fabric, foam, foil or film. The mean diameter of monofilaments is preferably from 8 to 400 μm or from 80 to 300 μm, in particular from 100 to 300 μm. Multifilaments advantageously consist of from 8 to 48 individual filaments, where the mean diameter of the individual filaments is preferably from 8 to 40 μm.

The thickness of foils of the invention is generally from 30 to 2000 μm, from 30 to 1000 μm, from 30 to 800 μm, from 30 to 600 μm, from 30 to 400 μm, from 30 to 200 μm or from 50 to 200 μm. The width of the foils is generally from 0.1 to 6 m, their length generally being from 0.1 to 10 000 m.

Other preferred embodiments of the invention are characterized in that the molding comprises carbon black, where the mean equivalent diameter of the primary carbon black particles determined in accordance with ASTM D3849-14a on a solution of the composition is from 8 to 40 nm, from 8 to 30 m, from 8 to 20 nm or from 8 to 16 nm;

comprises carbon black, where the carbon black comprises aggregates with a mean equivalent diameter determined in accordance with ASTM D3849-14a on a solution of the molding composition is from 100 to 1000 m, from 100 to 300 nm or from 100 to 200 nm;

at a temperature of 24° C. has an electrical resistivity ρ of from 0.001 to 3.0 Ω·m, preferably from 0.01 to 0.1 Ω·m, particularly preferably from 0.01 to 0.09 Ω·m, specifically from 0.02 to 0.08 Ω·m or from 0.03 to 0.08 Ω·m;

at a temperature of 24° C. has an electrical resistivity ρ of from 0.04 to 0.08 Ω·m, from 0.06 to 0.1 Ω·m, from 0.08 to 0.12 Ω·m, from 0.1 to 0.3 Ω·m, from 0.2 to 0.4 Ω·m, from 0.3 to 0.5 Ω·m, from 0.4 to 0.6 Ω·m, from 0.3 to 0.5 Ω·m, from 0.4 to 0.6 Ω·m, from 0.5 to 0.7 Ω·m, from 0.6 to 0.8 Ω·m, from 0.7 to 0.9 Ω·m, from 0.8 to 1.0 Ω·m, from 1.0 to 2.0 Ω·m or from 2.0 to 3.0 Ω·m;

in the temperature range 24° C.≤T≤90° C. has a temperature-dependent resistivity of ρ(T), where the ratio ρ(T)/ρ(24° C.) increases with increasing temperature T from 1 to a value of from 1.1 to 30, preferably from 1.1 to 5, particularly preferably from 1.1 to 4, specifically from 1.1 to 3;

in the temperature range 24° C.≤T≤90° C. has a temperature-dependent resistivity of ρ(T), where the ratio ρ(T)/ρ(24° C.) increases with increasing temperature T from 1 to a value of from 10 to 21, preferably from 1 to a value of from 15 to 21;

in the temperature range 24° C.≤T≤90° C. has a temperature-dependent resistivity of ρ(T), where the ratio ρ(T)/ρ(24° C.) increases with increasing temperature T from 1 to a value of from 1.1 to 21 and the mean value of the increase gradient [ρ(T+ΔT)−ρ(T)]/[ρ(24° C.)·ΔT] in the increase range is from 0.1/° C. to 3.5/° C.;

in the temperature range 24° C.≤T≤90° C. has a temperature-dependent resistivity of ρ(T), where the ratio ρ(T)/ρ(24° C.) increases with increasing temperature T from 1 to a value of from 1.1 to 21 and the mean value of the increase gradient [ρ(T+ΔT)−ρ(T)]/[ρ(24° C.)·ΔT] in the increase range is from 0.1/° C. to 1.5/° C.;

in the temperature range 24° C.≤T≤90° C. has a temperature-dependent resistivity of ρ(T), where the ratio ρ(T) /ρ(24° C.) increases with increasing temperature T from 1 to a value of from 1.1 to 21 and the mean value of the increase gradient [ρ(T+ΔT)−ρ(T)]/[ρ(24° C.)·ΔT] in the increase range is from 0.8/° C. to 1.2/° C.;

at a temperature of 24° C. withstands a maximal tensile force of from 11 $N/mm^2$ to 1100 $N/mm^2$;

at a temperature of 24° C. has an elongation at break of from 5 to 60%, from 5 to 30%, from 5 to 20% or from 10 to 30%;

at a temperature of 24° C. has a modulus of elasticity of at least 110 $N/mm^2$, but preferably from 1800 to 3200 $N/mm^2$; and/or is configured as foil and at a temperature of 24° C. has a tensile impact resistance of from 40 to 60 $kJ/m^2$.

In an advantageous embodiment, the electrical resistivity ρ(T) of the molding of the invention at a temperature (T) above the phase-transition temperature of the phase-change material is from 1.1 to 30 times the electrical resistivity at a temperature below the phase-transition temperature, preferably from 1.5 to 21 times, particularly preferably from 3 to 10 times.

Another object of the invention consists in providing electrically heatable textiles. This object is achieved via a textile comprising monofilaments, multifilaments, fibers, nonwoven fabric, foam and/or foil made of the composition described above.

For the purposes of the present invention, the term "phase-change material" denotes an individual substance or else a composition made of two or more substances, where the phase-transition temperature of the individual substance or of at least one substance of the composition is in the range from −42° C. to +150° C. The phase transition is preferably a transition from solid to liquid, i.e. the phase-change material preferably has a main melting peak in the range from −42° C. to +150° C. The phase-change material consists by way of example of a paraffin or of a composition comprising a paraffin with one or more polymers, where the polymers bind and stabilize the paraffin.

The terms "sub-microscale" and "nanoscale" denote particles and bodies which in at least one spatial direction have a dimension of less than 1000 nm, or 100 nm or less. The term "microscale" is used for particles or platelets which in one spatial direction by way of example have a dimension of from 300 to 800 nm. The term "nanoscale" is used for particles or fibers which by way of example in one spatial direction have a dimension of from 10 to 50 nm.

The composition comprises at least one thermoplastic organic polymer or crosslinkable copolymer, one conductive filler, and phase-change materials, and also other inert or functional materials. The combination of materials is selected specifically for the desired application. PTC switching behavior at various transition temperatures is established by selecting suitable phase-change materials. Prior to use in the matrix polymer or in the matrix polymer blend, these materials themselves are preferably introduced into polymeric network structures and/or can be influenced in their rheology via additives. These phase-change materials thus modified are intimately mixed in the matrix polymer or the matrix polymer blend together with the conductive additives in a manner that gives a substantially homogeneous distribution. of the conductivity additives and of the phase-change materials. The polymer composition then exhibits a PTC effect. Other inert or functional additives can additionally be added to the composition of the invention, examples being heat stabilizers and/or UV stabilizers, oxidation inhibitors, adhesion promoters, dyes and pigments, crosslinking agents, process aids and/or dispersing agents. It is likewise possible to add other materials and fillers, in particular silicon carbide, boron nitride and/or aluminum nitride in order to increase thermal conductivity.

The matrix polymer or the matrix polymer blend—hereinafter termed compound material component A—comprises one or more crystalline, semicrystalline and/or amorphous polymers from the group of the polyethylenes (PE) such as LDPE, LLDPE, HDPE and/or of the respective copolymers, from the group of the atactic, syndiotactic and/or isotactic polypropylenes (PP) and/or the respective copolymers, from the group of the polyamides (PA), and among these in particular PA 11, PA 12, the PA 6.66 copolymers, the PA 6.10 copolymers, the PA 6.12 copolymers, PA 6 or PA 6.6, from the group of the polyesters (PES) having aliphatic constituents, having aliphatic constituents in combination with cycloaliphatic constituents and/or having aliphatic constituents in combination with aromatic constituents, and among these in particular polybutylene terephthalates (PBT), polytrimethylene terephthalates (PTT) and polyethylene terephthalates (PET), and also of the chemically modified polyesters, and among these in particular glycol-modified polyethylene terephthalates (PETG), from the group of the polyvinylidene fluorides (PVDF) and of the respective copolymers, from the group of the crosslinkable copolymers, and also from the group of the mixtures or blends of said polymers and/or copolymers.

The conductivity additive (compound material component B) present in the composition takes the form of micro- or nanoscale domains, micro- or nanoscale particles, micro- or nanoscale fibers, micro- or nanoscale needles, micro- or nanoscale tubes and/or micro- or nanoscale platelets, and is composed of one or more conductive polymers, carbon black, conductive carbon black, graphite, expanded graphite, single-wall and/or multiwall carbon nanotubes (CNT), open and/or closed carbon nanotubes, unfilled and/or metal-, for example silver-, copper- or gold-filled carbon nanotubes, graphene, carbon fibers (CF), flakes and/or particles made of a metal, for example Ni, Ag, W, Mo, Au, Pt, Fe, Al, Cu, Ta, Zn, Co, Cr, Ti, Sn or an alloy of two or more metals. The conductivity additive or compound material component B moreover optionally comprises a polymer in which the conductive particles have been dispersed in a manner such that compound material component B can be used as masterbatch in the production of moldings.

In a preferred embodiment of the invention, there is a phase-change material (compound material component D) bound into a polymeric network made of a compound material component C. Compound material component C comprises one or more polymers from the group of the terblock polymers consisting of styrene-butadiene-styrene (SBS) or of styrene-isoprene-styrene (SIS), the tetrablock polymers consisting of styrene-ethylene-butylene-styrene (SEBS), of styrene-ethylene-propylene-styrene (SEPS) or of styrene-poly(isoprene-butadiene)-styrene (SIBS), the terblock polymers consisting of ethylene-propylene-diene (EPDM), the terpolymers consisting of ethylene, vinyl acetate and vinyl alcohol (EVAVOH) of ethylene, methyl and/or ethyl and/or propyl and/or butyl acrylate and maleic anhydride (EAEMSA), of ethylene, methyl and/or ethyl and/or propyl and/or butyl acrylate and glycidyl methacrylate (EAEGMA) or of acrylonitrile, butadiene and styrene (ABS), the copolymers consisting of ethylene and maleic anhydride (EMSA), of ethylene and glycidyl methacrylate (EGMA), of ethylene and vinyl acetate (EVA), of ethylene and vinyl alcohol (EVOH), of ethylene and acrylate (EA), for example methyl (EMA) and/or ethyl (EEA) and/or propyl (EPA) and/or butyl acrylate (EBA), and/or from the group of the various types of polyethylenes (PE), for example LDPE, LLDPE, HDPE, and/or of the respective copolymers, inclusive of the graft copolymers of polyethylene, from the group of the atactic, syndiotactic and/or isotactic polypropylenes (PP) and/or of the respective copolymers, inclusive of the graft copolymers of polypropylene. The term "copolymer" here also includes terpolymers, and also polymers having units made of 4 or more different monomers.

In a preferred embodiment of the invention, a masterbatch is used which comprises the conductivity additive (compound material component B) and the phase-change material (compound material component D) dispersed in compound material component C.

It is advantageous to add, to the composition, a polymeric modifier which improves thermoplastic properties and processability. The polymeric modifier is preferably selected from the group comprising amorphous polymers, for example cycloolefin copolymers (COC), amorphous polypropylene, amorphous polyamides, amorphous polyesters and polycarbonates (PC).

In another embodiment of the invention, a micro- or nanoscale stabilizer is added to the phase-change material or to compound material component C.

The term "nanoscale materials" in the invention comprises additives which take the form of a powder, dispersion or polymer composite and comprise particles having at least. one dimension smaller than 100 nanometers, in particular thickness or diameter. Materials that can be used as nanoscale stabilizer are therefore preferably lipophilic, hydrophobized minerals with layer structure, e.g. lipophilic phyllosilicates, and among these lipophilic bentonites, where these exfoliate in plastification and mixing processes during the processing of the composition of the invention. The length and width of these exfoliated particles is generally about 200 nm to 1000 nm, and their thickness as generally about 1 nm to 4 nm. The ratio of length and width to thickness (aspect ratio) is preferably about 150 to 1000, preferably from 200 to 500. Other hydrophobic viscosity-increasing increasing materials preferably used are hydrophobized nanoscale fumed silicas. These nanoscale fumed silicas generally consist of particles with mean diameter preferably from 30 nm to 100 nm.

In another advantageous embodiment of the invention, a lubricant is used for appropriate adjustment of melt viscosity. The lubricant can be added to the phase-change material or to compound material component C.

The composition of the invention comprises a phase-change material (PCM), here also termed compound material component D. The phase-transition temperature of the phase-change material (compound material component D), at which its volume and its density undergo a reversible change, is in the range from −42° C. to +150° C., in particular from −30° C. to +96° C. The phase-change material or compound material component D is selected from the group comprising natural and synthetic paraffins, polyalkylene glycols (=polyalkylene oxides), preferably polyethylene glycols (=polyethylene oxides), polyester alcohols, highly crystalline polyethylene waxes and mixtures thereof, and/or the phase-change material is selected from the group comprising ionic liquids and mixtures thereof, and/or the phase-change material is selected from the group comprising mixtures which firstly comprise natural and synthetic paraffins, polyalkylene glycols (=polyalkylene oxides), preferably polyethylene glycols (=polyethylene oxides), polyester alcohols or highly crystalline polyethylene waxes, and which secondly comprises ionic liquids.

For the purposes of this invention, phase-change materials are any of the materials selected from the groups mentioned in the preceding paragraph with a phase-transition temperature, at which their volume and their density undergoes reversible change, in the range from −42° C. to +150° C., in particular from −30° C. to +96° C. These phase-change materials can be used here alone (without further treatment), in the form of materials bound into a polymer network, or in the form of mixtures of these two forms. Examples of materials suitable as phase-change materials without further treatment are polyester alcohols, polyether alcohols and polyalkylene oxides. In a preferred embodiment, the phase-change materials are used after binding into a polymer network. This polymer network is formed from at least one copolymer based on at least two different ethylenically unsaturated monomers (compound material component C). It is advantageous to add, to the composition, a polymeric modifier which improves thermoplastic properties and processability. The polymeric modifier is preferably selected from the group comprising amorphous polymers, for example cycloolefin copolymers (COC), polymethyl methacrylates (PMMA) amorphous polypropylene, amorphous polyamide, amorphous polyester and polycarbonates (PC).

The composition optionally comprises one or more additives, hereinafter termed compound material component E, selected from the group of flame-retardant substances and/or heat stabilizers and/or UV-visible-light stabilizers and/or oxidation inhibitors and/or ozone inhibitors and/or dye and/or color pigments and/or other pigments and/or foaming agents and/or adhesion promoters and/or processing aids and/or crosslinking agents and/or dispersing agents and/or other materials and fillers, in particular silicon carbide, boron nitride and/or aluminum nitride in order to increase thermal conductivity.

The composition advantageously comprises, based on its total weight, from 10 to 98% by weight of matrix polymer or matrix polymer blend and a total of from 2 to 90% by weight of conductivity additive and phase-change material, and also optionally other additives. It preferably comprises from 15 to 89% by weight of matrix polymer or matrix polymer blend and a total of from 11 to 85% by weight of conductivity additive and phase-change material, and also optionally other additives. The composition particularly preferably comprises from 17 to 50% by weight of matrix polymer or matrix polymer blend and a total of from 50 to 83% by weight of conductivity additive and phase-change material, and also optionally other additives.

The temperature range and the intensity of the PTC effect of the moldings produced from the composition can be adjusted appropriately for the requirements of an application via selection of the constituents and of the respective mass fraction of these.

The composition can be used to produce various moldings, for example monofilaments, multifilaments, staple fibers, closed-cell or open-cell or mixed-cell foams, integral foams, small- and large-surface-area layers, patches, films or foils. In a preferred embodiment of the invention, the moldings produced from the composition are cross-linked with the aid of crosslinking agents and/or by exposure to heat and/or to high-energy radiation, in order to achieve long lasting stabilization of electrical and thermal properties.

Use of thermoplastic processing methods can produce moldings, for example monofilaments, multifilaments, staple fibers, spunbond nonwoven fabrics, closed-cell or open-cell or mixed-cell foams, integral foams, small- and large-surface-area layers, patches, films, foils or injection moldings having a positive temperature coefficient of electrical resistance, or PTC effect. With the moldings of the invention it is possible to produce products whose electrical resistance on application of a prescribed electrical voltage U in the range from 0.1 V to 240 V increases significantly with increasing temperature within a defined temperature range, resulting in reduced electrical current and restriction of electrical power consumed in the product.

The invention is explained in more detail with reference to figures.

Figure 1B:
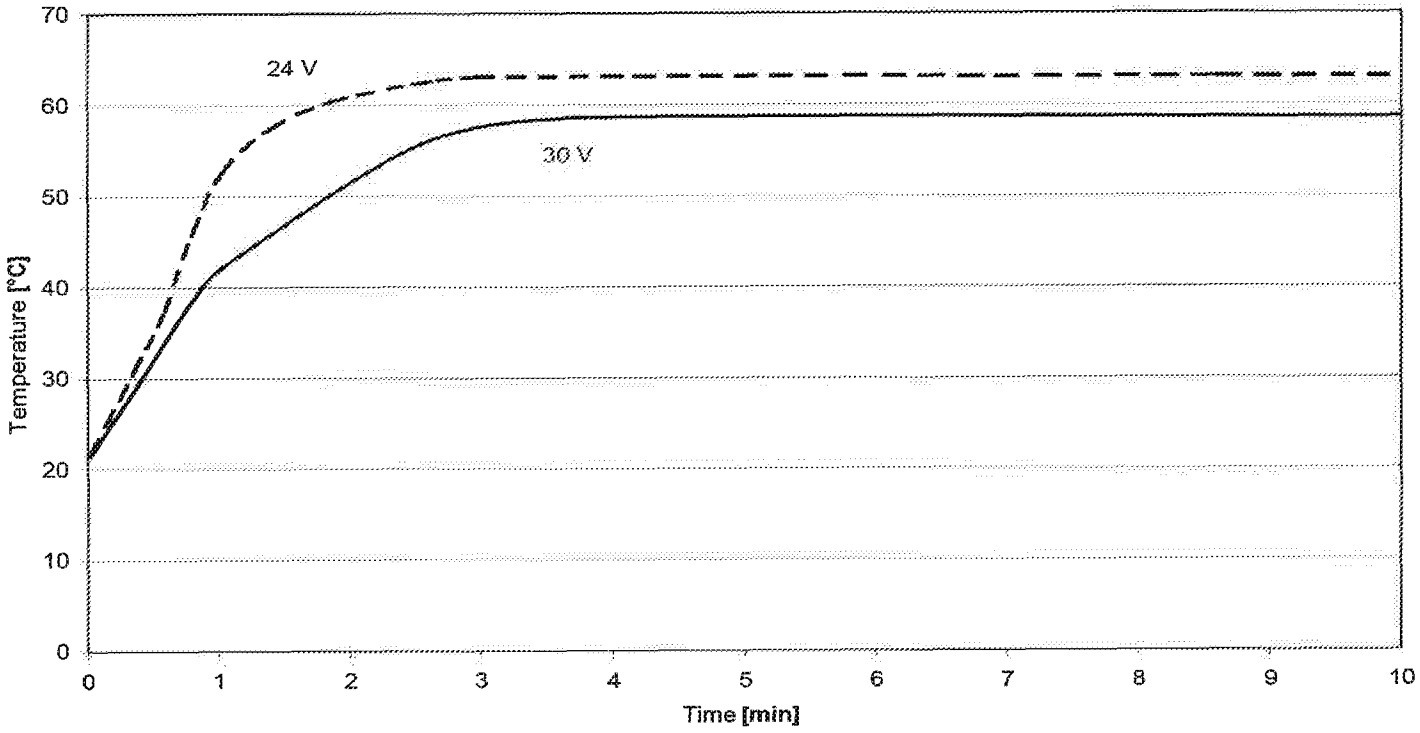
FIG. 1B graphically illustrates the temperature of the exemplary heating textile of FIG. 1 A as a function of time.
Figure 2:
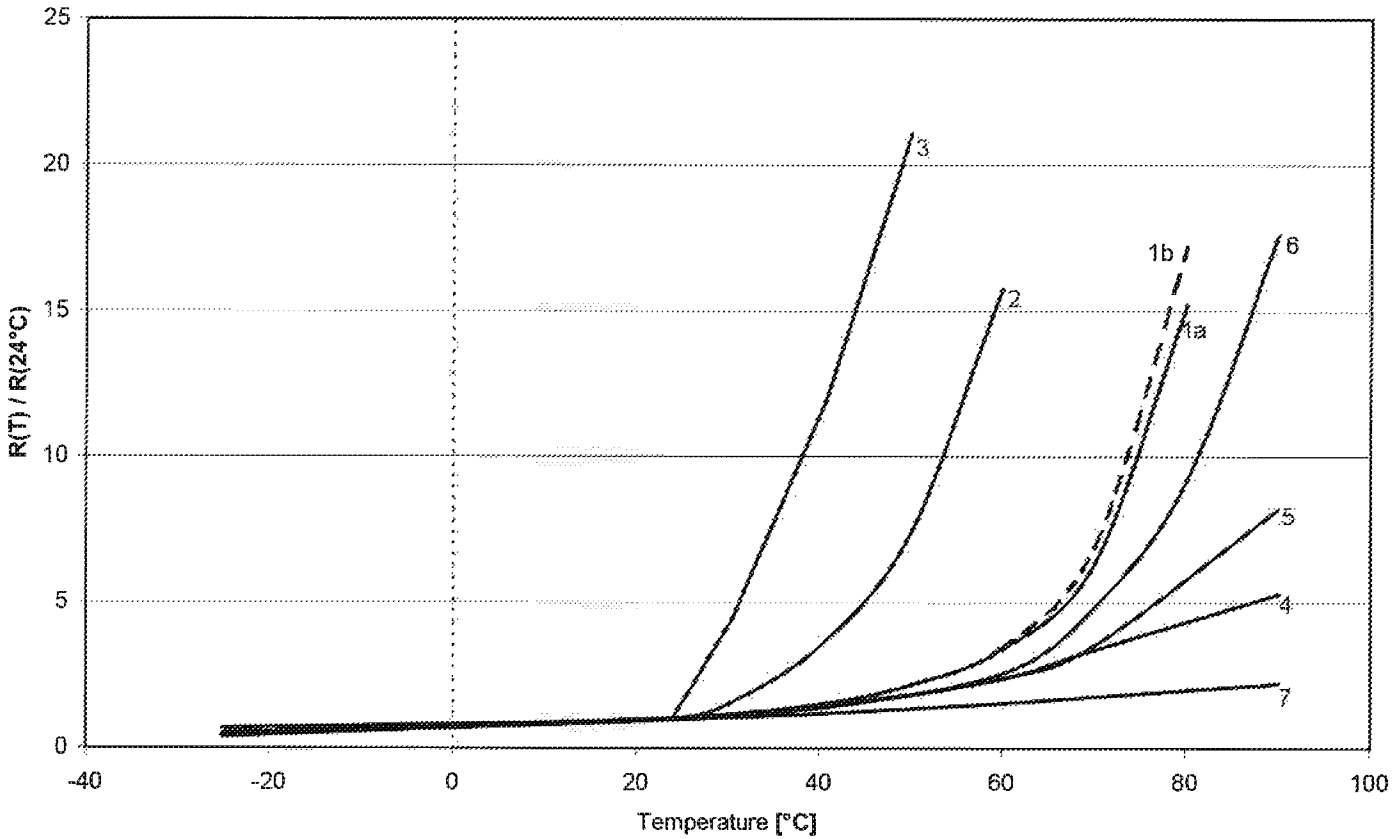
FIG. 2 graphically illustrates the standardized electrical resistance R(T)/R(24° C.) of exemplary PTC mono- and multifilaments.

FIG. 1A shows electrical current as a function of time in a heating textile comprising PTC filament yarn;

FIG. 1B shows the temperature of the heating textile of FIG. 1A as a function of time;

FIG. 2 shows the standardized electrical resistance R(T)/R(24° C.) of PTC mono- and multifilaments.

The temperature range and the intensity of the PTC effect can be adjusted via variation of compound material components A, B, C, D and optionally E. This behavior is documented by FIG. 1A and FIG. 1B. FIG. 1A shows electrical current I, and FIG. 1B shows temperature T, in each case as a function of time, for a "self-regulating" heating textile.

The "self-regulating" heating textile was produced with use of a PTC monofilament of the invention with diameter 300 μm as weft in a carrier textile made of polyester multifilaments. A heat output up to 248 watts per square meter can be generated by the heating textile when a voltage of 24 volts is applied.

FIG. 1A shows current as a function of time in a heating textile which comprises PTC filament yarn of the invention, to which an electrical voltage U of either 24 V or 30 V is applied. According to Ohm's law, the power output generated in the heating textile or in the PTC filament yarn present therein is calculated from the relationship $P_{\Omega}=U/R^2$. The electrical energy consumed in the heating textile during a period ΔT, or the resultant electrical work W, where $W=P_{\Omega}$. Δt, is almost entirely converted into heat, increasing the temperature of the heating textile. Some of the heat generated in the heating textile is dissipated to the environment via radiated heat and convection. The heat remaining in the heating textile causes a continuous temperature increase, in particular in the PTC filaments. As soon as the temperature of the heating textile approaches the phase-transition temperature of the phase-change material present in the PTC filament yarn, some of the phase-change material begins to melt. Associated with this is decreased density of the phase-change material and correspondingly increased volume thereof. This progressive volume increase results in increased electrical resistance of the PTC filament yarn, and decreased heat output $P_{\Omega}=U/R^2$. At a certain temperature, and a resistance corresponding thereto, a thermal equilibrium is established, where the electrical energy introduced into the heating textile per unit of time balances the heat generated by the heating textile. In the thermal equilibrium, with a certain electrical voltage applied, the resultant current, as illustrated by FIG. 1A, and the electrical resistance, and consequently the temperature of the heating textile, are constant. As can be seen from FIG. 1A, after a relatively short period of about 4 to 5 minutes not only the current but also the electrical resistance of the heating textile is constant, the value assumed by the latter in the thermal equilibrium being either R=24 V/0.13 A=185 Ω or R=30 V/0.1 A=300 Ω, depending on the electrical voltage. The corresponding electrical heat output is $P_{\Omega}=(24\ V)^2/185\ \Omega=3.1$ W and, respectively, $P_{\Omega}=(30\ V)^2/300=3.0$ W. From the abovementioned electrical power, this textile generates, in the thermal equilibrium, a constant quantity of heat per unit of time. In this condition, the temperature of the heating textile is therefore also constant.

FIG. 1B shows the temperature of this specific heating textile as a function of time. With an applied voltage of 24 V and, respectively, 30 V the temperature in the thermal equilibrium. assumes values of 63° C. and, respectively, 59° C.

FIG. 2 shows the standardized electrical resistance R(T)/R(24° C.) of PTC mono- and multifilaments produced in the invention, as a function of temperature. The maximal value and the gradient of the standardized resistance R(T)/R(24° C.) on the region of the phase transition are subsumed in the technical literature under the term "PTC intensity". The respective measured curves are denoted by the numerals 1*a*, 1*b* and 2 to 7 in FIG. 2, the numerals being abbreviations for the filaments in the examples of the invention:

1*a*="PTC monofilament_01*a*"
1*b*="PTC monofilament_01*b*"
2="PTC monofilament_02"
3="PTC monofilament_03"
4="PTC monofilament_04"
5="PTC monofilament_05"
6="PTC monofilament_06"
7="PTC monofilament_07".

As can be seen from FIG. 2, the temperature at which the resistance of the filament increases can be varied, for example in the range of about 20° C. to 90° C., via selection of a suitable phase-change material and the corresponding conductivity additive. We describe below the phase-change material present in each filament, the corresponding conductivity additive, and the relevant mass fractions of these, and also of the other components of the polymer composition which can be used to influence the "PTC intensity", and also the linear density of each filament.

By varying the concentration of the constituents of the composition, it is possible to produce mono- and multifilaments with differing PTC characteristic or resistance-temperature profile.

The monofilaments denoted by "PTC monofilament_01*a*) and "PTC monofilament_01*b*" comprise a phase-change material (PCM) with melting range from 45° C. to 63° C. and with main melting peak at a temperature of 52° C. The proportion of the phase-change material was 5.25% by weight. The two curves (a) and (b) provide evidence of the good reproducibility of the production process. Although "PTC monofilament_01*a*" and "PTC monofilament_01*b*" derive from different filament wheels, the difference between the curves (a) and (b) is negligible. The monofilaments denoted by "PTC monofilament_02" and "PTC monofilament_03" used a phase-change material with main melting peak at a temperature of 35° C. and, respectively, 28° C. The PTC effect in both monofilaments is therefore observable at correspondingly lower temperatures than for "PTC monofilament_01". The monofilaments denoted by "PTC monofilament_05", "PTC monofilament_04" and "PTC monofilament_07" used the same phase-change material as "PTC monofilament_01", in each case with a proportion by weight of 5.25% by weight, and the phase-change material therefore exhibited a main melting peak at a temperature T=52° C. However, the monofilaments "PTC monofilament_05", "PTC monofilament_04" and "PTC monofilament_07" differ in their electrical conductivity because in each case their nature, composition and proportion of the conductivity component B varies. This has a significant effect on the starting level of the electrical resistance of the filaments at 24° C.: The resistance of the monofilament "PTC monofilament_07" was only R=0.6 MΩ/m, whereas the resistance of "PTC monofilament_04" is 17.9 MΩ/m, of "PTC monofilament_05" is R=22.0 MΩ/m and of "PTC monofilament_01" is R=26.1 MΩ/m. The sample denoted by "PTC multifilament_06" is a multifilament with linear density 307 dtex (36-filament). It was produced from a material that, by virtue of the nature and the proportion of the conductivity component B, gives relatively good electrical conductivity and at the same time permits production of multifilaments. The electrical resistance of the multifilament yarn "PTC multifilament_06" at 24° C. was 13.1 MΩ/m, which was therefore lower than for the monofilaments with linear density 760 dtex and diameter 300 μm. The PTC intensity of the multifilament yarn in essence corresponded to the behavior observed for monofilaments.

There are many different possible uses and applications of the moldings of the invention with PTC, because they can be used either with low voltages of from 0.1 volt to 42 volts or with relatively high electrical voltages of up to 240 volts, and also with direct or alternating voltage, and frequencies of up to 1 megahertz, and they have electrical and thermal properties that exhibit long-term stability.

It is preferable to use carbon black as conductivity additive. Carbon black is produced by various processes. Terms also used for the resultant carbon black, these being dependent on production process or starting material, are "furnace black", "acetylene black", "plasma black" and "activated carbon". Carbon black consists of what are known as primary carbon black particles with mean diameter in the range from 15 to 300 nm. As a result of the production process, a large number of primary carbon black particles in each case forms what is known as a carbon black aggregate in which sinter bridges having very high mechanical stability connect adjacent primary carbon black particles to one another. Electrostatic attraction causes clumping of the carbon black aggregates, to give agglomerates exhibiting various levels of binding. Carbon black suppliers differ in respect of optional additional granulation or pelletization of the carbon black aggregates and carbon black agglomerates.

During the processing of polymer compositions comprising carbon black as additive in processes involving melting, for example extrusion, melt spinning and injection molding, the carbon black aggregates and carbon black agglomerates are exposed to shear forces. The maximal shear force acting in a polymeric melt depends in a complex manner on the geometry and the operating parameters of the extruder or gelling assembly used, and also on the rheological properties of the polymeric composition and its temperature. The maximal shear force acting in the process can exceed the electrostatic binding force and split carbon black agglomerates into carbon black aggregates, which become dispersed in the melt. On the other hand, increased agglomeration or flocculation can occur in low-viscosity polymeric melts or solutions where there is high mobility of the carbon black aggregates and low shear force.

The conductivity of a polymer molding comprising carbon black is decisively influenced by the proportion, distribution and morphology of the carbon black agglomerates and carbon black aggregates. As explained above, the distribution and morphology of carbon black in a polymer molding produced by processes involving melting depends on the nature of the carbon black additive, the rheological properties of polymer composition and the process parameters. It is necessary to adjust the process parameters in a suitable manner, as required by the proportion and nature of the carbon black additive and of the other components of the polymer composition, in a manner that provides the prescribed conductivity to the molding. The influence exerted by, and the interaction between, the physical properties of the carbon black additive, the other constituents of the polymer composition and the process parameters is an extremely complex matter which hitherto has not been adequately understood.

The technical literature contains indications that break-up of carbon black agglomerates and uniform dispersion of carbon black aggregates by high shear forces in polymer melts prevents formation of a network of carbon black agglomerates and reduces conductivity by several orders of magnitude.

Surprisingly, the experiments carried out by the inventors lead to the obvious conclusion that use of phase-change materials in various polymer matrices can achieve fine and uniform dispersion of carbon black agglomerates and carbon black aggregates in polymer moldings and that conductivity is improved. It has therefore been possible to produce polymer moldings which, with a prescribed upper limit of 30% by weight for the proportion of carbon black, have conductivity up to 100 S/m (corresponding to resistivity $\rho=0.01\ \Omega\cdot m$) and in particular cases up to 1000 S/m ($\rho=0.001\ \Omega\cdot m$).

In the examples below, all of the starting materials or components, i.e. all of the polymers, polymer blends and additives, were processed only after careful drying in vacuum drying cabinets. As already explained above, the phase-change material can comprise one or more substances. The phase-change material in the examples comprises a compound material component C functioning as network-former and stabilizer, and a compound material component ID which is a substance, in particular a paraffin, with a phase transition in the temperature range from about 20° C. to about 100° C. Unless otherwise stated or obvious from the context, percentages are percentages by weight.

EXAMPLE 1

Monofilament

The matrix polymer, or compound material component A, consists of a mixture with a proportion of 39.8% by weight of MOPLEN® 462 R polypropylene and a proportion of 22.5% by weight of LUPOLEN® low-density polyethylene (LDPE), and a proportion of 22.5% by weight of "Super Conductive Furnace N 294" conductive carbon black was used as conductivity additive or compound material component B. Compound material component C consisted of a blend of styrene block copolymer and poly(methyl methacrylate), the proportion of each being 2.25% by weight. 10.5% by weight of Rubitherm RT52 paraffin with main melting peak at a temperature of 52° C. was used as compound material component D or phase-change material in the narrower sense. 0.2% by weight of a mixture of 0.06% by weight of IRGANOX® 1010, 0.04% by weight of IRGAFOS® 168 and 0.10% by weight of calcium stearate was used as further compound material component E.

In a separate step, compound material component D, i.e. the paraffin, is first plastified and homogenized together with the styrene block copolymer and the poly (methyl methacrylate) in a kneading assembly equipped with a granulator, and the mixture is then granulated. The composition of the PCM granulate was as follows:

70 * % by weight PCM (Rubitherm RT52, Rubitherm Technologies GmbH);

15 * % by weight SEEPS (SEPTON® styrene block copolymer, Kuraray Co. Ltd);

15 * % by weight PMMA (PMMA 7N uncolored, Evonik AG);

where the quantitative data in * % by weight are based on the total weight of the PCM granulate. The mean grain diameter of the PCM granulate was 4.5 mm.

This PCM granulate, the matrix polymers polypropylene MOPLEN® 462 R) in granulate form and polyethylene (LUPOLEN® LDPE) in granulate form, and also compound material component E, were mixed together and charged to an extruder hopper. The conductive carbon black, or the compound material component B, was charged to metering equipment connected to the extruder. The metering equipment permits uniform introduction of the conductive carbon black into the polymer melt. The extruder is a RHEOMEX™ PTW 16/25 corotating twin-screw extruder from Haake with standard configuration, i.e. with segmented screws without back-conveying elements. The contents of the hopper, and the conductive carbon black, were plastified, homogenized and extruded by the extruder. During the entire extrusion process, the hopper extruder and the metering equipment were blanketed with nitrogen. The screw rotation rate was 180 rpm, and the mass throughput was about 1 kg/h. The temperature of the extruder zones were as follows: 220° C. at the intake, 240° C. in zone 1, 260° C. in zone 2, 240° C. in zone 3 and 220° C. at the strand die. The internal diameter of the strand die was 3 mm. The extruded and cooled polymer strand was granulated in a granulator. The composition of the polymer granulate thus obtained was as follows:

39.8% by weight of polypropylene as part of compound material component A;

22.5% by weight of low-density polyethylene (LDPE) as part of compound material component A;

22.5% by weight of conductive carbon black as compound material component B;

15.0% by weight of PCM granulate with 10.5% by weight of paraffin as compound material component D, and also respectively 2.25% by weight of SEEPS and PMMA as compound material component C;

0.2% by weight of additives as compound material component E.

This granulate was dried and served as starting material for the production of monofilaments in a filament extrusion system from FET Ltd., Leeds. The filament extrusion system comprises a single-screw extruder with screw diameter 25 mm and length-to-diameter ratio L/D=30:1. The mass throughput of polymer melt was 13.7 g/min. The following composition temperature regime was implemented: 200° C. in zone 1, 210° C. in zone 2, 220° C. in zone 3, 230° C. in zone 4, 240° C. in zone 5, 250° C. in zone 6 and 260° C. at the filament die. The die perforation diameter was 1 mm. The extruded polymer melt was cooled in a water to at 20° C. and the solidified monofilament was drawn in-line in a process step using three draw units. The circumferential velocity here was 58.2 m/min for the godets of the first draw unit and 198 m/min for those of the second draw unit. A draw bath ranged between the first and second draw unit contained water at 90° C. After the second draw unit, the monofilament was passed via a heating oven onto the third draw unit. The circumferential velocity of the godets of the third draw unit was likewise 198 m/min. The drawn monofilament was then wound on a K 160 shell. The winder was operated at a velocity of 195 m/min. The draw ratio was 1:3.4. The diameter of the monofilament thus produced is 300 μm.

Characterization of the monofilament in respect of its physical properties gave elongation 23%, tensile strength 62 mN/tex and initial modulus 1024 MPa.

The electrical resistance of the monofilament as a function of temperature was measured in a four-point device arranged in a controlled-temperature and humidity chamber. The temperature was increased here stepwise from 24° C. (room temperature) to values of 30° C., 40° C., 50° C., 60° C., 70° C. and 80° C. 8 pieces of the monofilament were tested simultaneously, the test distance or test length in each case being 75 mm. The electrical resistance of the monofilament at room temperature is R(24° C.)=2.6 MΩ/m. Heating of the monofilament to a temperature of 80° C. increases the resistance to R(80° C.)=19.0 MΩ/m. Resistance returned to the initial value after cooling of the monofilament to room temperature. At a temperature of 80° C., the resistance ratio R(T)/R(24° C.) shown in FIG. 2 as a function of the temperature, and therefore as a measure of PTC intensity, is R(80° C.)/R(24° C.)=7.3. This is a consequence of the comparatively moderate electrical conductivity, i.e. of the relatively high electrical resistance at room temperature of 2.6 MΩ/m for this monofilament produced as described with use of the specific polymer composition.

EXAMPLE 2

Multifilament

A blend of a proportion of 34.3% by weight of MOPLEN® 462 R polypropylene and a proportion of 30% by weight of LUPOLEN® low-density polyethylene (LDPE) was used as matrix polymer or compound material component A, and a proportion of 28.0% by weight of "Super Conductive Furnace N 294" conductive carbon black was used as conductivity additive or compound material component B. Compound material component C consisted of a blend of styrene block copolymer and poly(methyl methacrylate), the proportion of each being 1.125% by weight. 5.25% by weight of Rubitherm RT55 paraffin with main melting peak at a temperature of 55° C. were used as compound material component D or phase-change material in the narrower sense. 0.2% by weight of a mixture of 0.06% by weight of Irganox® 1010, 0.04% by weight of Irgafos® 168 and 0.10% by weight of calcium stearate was used as further compound material component E.

In a separate step in a kneading assembly equipped with a granulator, a PCM granulate was first produced, consisting of paraffin as phase-change material, and also styrene block copolymer and poly(methyl methacrylate) as binder or stabilizer. The composition of the PCM granulate was as follows:

70 * % by weight PCM (Rubitherm RT55, Rubitherm Technologies GmbH);

15 * % by weight SEEPS (SEPTON® styrene block copolymer, Kuraray Co. Ltd);

15 * % by weight PMMA (PMMA 7N uncolored, Evonik AG)

where the quantitative data in * % by weight are based on the total weight of the PCM granulate. The mean grain diameter of the PCM granulate was 4.5 mm.

This PCM granulate, the matrix polymers polyethylene (Lupolen® LUPOLEN® LDPE) in granulate form, polypropylene (MOPLEN® 462 R) in granulate form, and the compound material component E were mixed together and charged to an extruder hopper. The conductive carbon black, or the compound material component B, was charged to metering equipment connected to the extruder. The metering equipment permits uniform introduction of the conductive carbon black into the polymer melt. The extruder is a Rheomex RHEOMEX® PTW 16/25 corotating twin-screw extruder from Haake with standard configuration, i.e. with segmented screws without back-conveying elements. The contents of the hopper, and the conductive carbon black, were plastified, homogenized and extruded by the extruder. During the entire extrusion process, the hopper extruder and the metering equipment were blanketed with nitrogen. The screw rotation rate was 180 rpm, and the mass throughput was about 1 kg/h. The temperature of the extruder zones were as follows: 220° C. at the intake, 240° C. in zone 1, 260° C. in zone 2, 240° C. in zone 3 and 220° C. at the strand die. The internal diameter of the strand die was 3 mm. The extruded and cooled polymer strand was granulated in a granulator. The composition of the granulate thus obtained was as follows:

34.3% by weight of polypropylene as part of compound material component A;

30.0% by weight of low-density polyethylene (LDPE) as part of compound material component A.

28.0% by weight of conductive carbon black as compound material component B;

7.5% by weight of PCM granulate with 70% by weight of paraffin as compound material component D, and also respectively 15% by weight of SEEPS and PMMA as parts of compound material component C;

0.2% by weight of additives as compound material component E.

This granulate was dried and served as starting material for the production of multifilament yarn in a filament extrusion system from FET Ltd., Leeds. The granulate was processed in a filament extrusion system from FET Ltd., Leeds. The filament extrusion system comprises a single-screw extruder with screw diameter 25 mm and length-to-diameter ratio L/D=30:1. The mass throughput of polymer melt was 20 g/min. The following composition temperature regime was implemented.: 190® C. in zone 1, 190° C. in zone 2, 190° C. in zone 3, 190° C. in zone 4, 190° C. in zone 5, 190° C. in zone 6 and 190° C. at the spinning die. The spinning die has 36 perforations each of diameter 200 μm. The polymer melt emerging from the spinning die was cooled at an air temperature of 25° C. in a cooling shaft, and the multifilament thus solidified was drawn in-line in a step using four godet pairs. Circumferential velocity here was 592 m/min for the take-off godet, 594 m/min for the first godet pair, 596 m/min for the second godet pair, 598 m/min for the third godet pair and 600 m/min for the fourth godet pair. The multifilaments were then wound on a K 160 shell. The winder was operated at a velocity of 590 m/min. The linear density of the resulting multifilament yarn was 307 dtex (36-filament).

In a downstream step, the multifilament yarn was subjected to afterdrawing in a three-stage draw unit. Circumferential velocity was 60 m/min for the godets of the first draw stage and 192 m/min respectively for those of the second and third draw stage. Between the first and second draw stage, the multifilament was passed through a water-filled draw bath at 90° C. Between the second and third draw stage, the multifilament yarn was passed through a heating tunnel. The multifilament yarn was then wound on a K 160 shell. The winder was operated at a velocity of 190 m/min. The draw ratio of the multifilament yarn thus treated, with linear density 96 dtex (36-filament) was 1:3.2.

Characterization of the flat multifilament yarn processed in this way in respect of its physical properties gave elongation 19%, tensile strength 136 mN/tex and initial modulus 1431 MPa. The diameter of the individual filaments of the multifilament yarn was 17 μm.

Properties measured on the multifilament yarn not subjected to afterdrawing, with linear density 307 dtex (36-filament) were: 192%, tensile strength 38 mN/tex and initial modulus 1190 MPa. The diameter of the individual filaments of the multifilament yarn not subjected to afterstretching was 31 μm.

The electrical resistance of the non-stretched multifilament yarn was measured as a function of temperature by a four-point device arranged in a controlled-temperature and —humidity chamber. The temperature was increased here stepwise from 24° C. (room temperature) to values of 30° C., 40° C., 50° C., 60° C., 70° C. and 80° C. 8 pieces of the multifilament yarn were tested simultaneously, the test distance or test length in each case being 75 mm. The electrical resistance of the multifilament yarn at room temperature is R(24° C.)=13 MΩ/m. Heating of the multifilament yarn to a temperature of 80° C. increases the resistance to R(80° C.)=119 MΩ/m. Resistance returned to the initial value after cooling of the multifilament yarn to room temperature. At a temperature of 80° C., the resistance ratio R(T)/R(24° C.) shown in FIG. 2 as a function of the temperature, and therefore as a measure of PTC intensity, is R(80° C.)/R(24° C.)=9.1. This value increased to R(90° C.)/R(24° C.)=17.8 at a temperature of 90° C.

This multifilament yarn was produced by using a polymer composition that, by virtue of the proportion, and also the nature, of conductivity component B gave relatively good electrical conductivity and nevertheless could be used to produce multifilaments amenable to drawing. The electrical resistance of the multifilament yarn with linear density 307 dtex (36-filament) at a temperature of 24° C., based on linear density or cross-sectional area, is smaller by a factor of 4.6 than that of the monofilament with linear density 760 dtex (diameter 300 μm). As can be seen from FIG. 2, the PTC intensity of the multifilament yarn substantially corresponds to that of monofilaments.

EXAMPLE 3

Foil

A blend of a proportion of 34.3% by weight of MOPLEN® 462 R polypropylene and a proportion of 30 % by weight of LUPOLEN® low-density polyethylene (LDPE) was used as matrix polymer or compound material component A, and a proportion of 28.0% by weight of "Super Conductive Furnace N 294" conductive carbon black was used as conductivity additive or compound material component B. Compound material component C consisted of a blend of styrene block copolymer and poly(methyl methacrylate), the proportion of each being 1.125% by weight, 5.25% by weight of Rubitherm RT55 paraffin with main melting peak at a temperature of 55° C. were used as compound material component D or phase-change material in the narrower sense. 0.2% by weight of a mixture of 0.06% by weight of IRGANOX® 1010, 0.04% by weight of IRGAFOS® 168 and 0.10% by weight of calcium stearate was used as further compound material component E.

In a separate steps in a kneading assembly equipped with a granulator, a PCM granulate was first produced, consisting of paraffin as phase-change material, and also styrene block copolymer and poly(methyl methacrylate) as binder or stabilizer. The composition of the PCM granulate was as follows:

70 * % by weight PCM (Rubitherm RT55, Rubitherm Technologies GmbH);

15 * % by weight SEEPS SEPTON® styrene block copolymer, Kuraray Co. Ltd);

15 * % by weight PMMA (PMMA 7N uncolored, Evonik AG);

where the quantitative data in * % by weight are based on the total weight of the PCM granulate. The mean grain diameter of the PCM granulate was 4.5 mm.

This PCM granulate, the matrix polymers polyethylene (LUPOLEN® LDPE) in granulate form, polypropylene (MOPLEN® 462 R) in granulate form, and the compound material component E were mixed together and charged to an extruder hopper. The conductive carbon black, or the compound material component B, was charged to metering equipment connected to the extruder. The metering equipment permits uniform introduction of the conductive carbon black into the polymer melt. The extruder is a RHEOMEX™ PTW 6/25 corotating twin-screw extruder from Haake with standard configuration, i.e. with segmented screws without back-conveying elements. The contents of the hopper, and the conductive carbon black, were plastified, homogenized and extruded by the extruder. During the entire extrusion process, the hopper extruder and the metering equipment were blanketed with nitrogen. The screw rotation rate was 180 rpm, and the mass throughput was about 1 kg/h. The temperature of the extruder zones were as follows: 220° C. at the intake, 240° C. in zone 1, 260° C. in zone 2, 240° C. in zone 3 and 220° C. at the strand die. The internal diameter of the strand die was 3 mm. The extruded and cooled polymer strand was granulated in a granulator. The composition of the granulate thus obtained was as follows:

34.3% by weight of polypropylene as part of compound material component A;

30.0% by weight of low-density polyethylene (LDPE) as part of compound material component A;

28.0% by weight of conductive carbon black as compound material component B;

7.5% by weight of PCM granulate with 70% by weight of paraffin as compound material component D, and also respectively 15% by weight of SEEPS and PMMA as parts of compound material component C;

0.2 % by weight of additives as compound material component E.

This granulate was ground to powder in a planetary ball mill under a blanket of nitrogen, and the resultant powder was dried for 16 hours in a vacuum drying cabinet. The dried powder served as starting material for the production of foil by a vertical "Randcastle Microtruder" single-screw extruder with seven regulatable temperature zones (3 zones at the extruder head, 3 zones between the extruder head and the flat-film die and 1 zone at the flat-film die). The single-screw extruder has a screw with diameter 0.5 inch (=1.27 cm) and length-to-diameter ratio L/D=24:1. The capacity or melt volume of e extruder is 15 $cm^3$, and the maximal compression ratio is 3.4:1.

The powder was charged to the extruder hopper under a blanket of nitrogen. The temperatures in the seven extruder zones were 190° C. in zone 1, 200° C. in zone 2, and respectively 210° C. in zone 3, 4, 5, 6 and 220° C. at the flat-film die. The slot width of the flat-film die was 50 mm and its gap size was 300 μm. The single-screw extruder was operated with a screw rotation rate of 8 revolutions per minute and with a mass throughput of 3.5 g/min. The polymer melt or polymer web emerging from the flat-film die was drawn off by way of a chill roll and downstream belt-take-off equipment at a velocity of 0.6 m/min. The temperature of the chill roll was 36° C. Foil webs of width from 40 to 50 mm and thickness from 160 to 240 μm could be produced continuously via variation of the above process parameters. The elongation of a foil thus produced with width 45 mm and thickness 180 μm was 448%, and its tensile strength was 34 $N/mm^2$.

The electrical resistance of the resultant foils as a function of temperature was determined in accordance with DIN EN 60093:1993-12 in a chamber under controlled conditions of temperature and humidity. The temperature was increased in 10° C. steps from 24° C. (room temperature.) to values of 30° C., 40° C., 50° C., 60° C., 70° C. and 80° C. Resistance values of R(24° C.)=18.4 mΩ and R(80° C.)=48.0 mΩ were measured on a foil sample of thickness 180 μm and area 28.3 $cm^2$ at 24° C. and 80° C. After cooling of the foil from 80° C. to 24° C. resistance returned to its initial value. The resistance ratio R(T)/R(24° C.) as a function of temperature serves as indicator for PTC intensity, and was R(T)/R(24° C.)=2.6.

The following methods are used to measure the physical properties of the molding of the invention and of the conductivity additive present therein:

| Property | Method |
|---|---|
| Filament: diameter | DIN EN ISO 137:2016-05 |
| Filament: maximum tensile force and elongation, modulus of elasticity | DIN EN ISO 2062:2010-4 |
| Filament: resistivity | Measurement of resistance in chamber under controlled conditions of temperature and humidity |
| Foil: thickness | DIN 53370:2006 |
| Foil: modulus of elasticity (tensile modulus), elongation at break | DIN EN ISO 527:2012 |
| Foil: tensile impact resistance | DIN EN ISO 8256:2005 |
| Foil: resistivity | DIN EN 60093:1993-12, measurement of resistance by two-electrode device in chamber under controlled conditions of temperature and humidity |
| Conductivity additive: specific surface area (iodine adsorption.) | ASTM D1510-16 |
| Conductivity additive: oil absorption number | ASTM D2414-16 |

-continued

| Property | Method |
|---|---|
| Conductivity additive: oil absorption number after compression | ASTM D3493-16 |
| Conductivity additive: void volume under compression | ASTM D6086-09a, at a geometric-mean pressure of 50 MPa, using a Micromeritics DVVA II dynamic volume analyzer |
| Conductivity additive: equivalent diameter of primary carbon black particles and carbon black aggregates | ASTM D3849-14a |
| Conductivity additive: equivalent diameter of primary particles and aggregates in polymeric samples | ASTM D3849-14a, using a solution of the polymeric sample |

In the table above, and for the purposes of the present invention, the term "equivalent diameter" means the diameter of an "equivalent" spherical particle having the same chemical composition and areal section (electron microscope imaging) as the particle under consideration. In practical terms, the areal section of each (irregularly shaped) particle under consideration is assigned to a spherical particle having a diameter commensurate with the measured signal.

The distribution of carbon black agglomerates and carbon black aggregates in the moldings of the invention is determined in accordance with ASTM D3849-14a. For this, a volume of about 1 ml of the molding under consideration is first dissolved in a suitable solvent, for example hexafluoroisopropanol, m-cresol, 2-chlorophenol, phenol, tetrachloroethane, dichloroacetic acid, dichloromethane or butanone. If required by the nature of the matrix polymer, the solution is prepared at elevated temperature and over a period of up to 24 h. The resultant polymeric solution is dispersed or diluted with the aid of ultrasound in about 3 ml of chloroform, and applied to sample grids for analysis by scanning transmission electron microscope (STEM). The images produced by the STEM from the dilute polymeric solutions are evaluated by image-analysis software, for example ImageJ in order to determine the area or equivalent diameter of the carbon black agglomerates and carbon black aggregates.

What is claimed is:

1. An electrically conductive molding with inherent positive temperature coefficient made of a polymer composition which comprises at least one organic matrix polymer as compound material component A, at least one submicro- or nanoscale electrically conductive additive as compound material component B and at least one phase-change material with a phase-transition temperature in the range from = 42° C. to 150° C. as compound material component D, and the melting range of the polymer composition is within the range from 100° C. to 450° C.

wherein phase-change material is used without further treatment or has been bound into an organic network made of at least one copolymer based on at least two different ethylenic monomers as compound material component C, the phase-change material has been selected in a manner such that the positive temperature coefficient intensity of the polymer composition exhibits a significant rise in the temperature range of the main melting peak of the phase changing material, and the positive change coefficient effect results from an increase in the volume of the phase-change material as a consequence of the temperature increase, and when the positive temperature coefficient takes effect the electrically conductive molding does not experience any changes in the morphology of the crystalline structures and does not melt, and there is no impairment of the service properties of the electrically conductive molding, where the molding comprises from 10 to 90% by weight of matrix polymer, from 0.1 to 30% by weight of the electrically conductive additive, from 2 to 50% by weight of the phase-change material with a phase-transition temperature in the range from 42° C. to 150° C., from 0 to 10% by weight of stabilizers, modifiers and dispersing agents and from 0 to 10% by weight of processing aids, based in each case on the total weight of the molding, where the sum of the percentages by weight of the individual constituents is 100% by weight.

2. The molding as claimed in claim 1, wherein the molding is a monofilament, a multifilament, a fiber, a nonwoven fabric, a foam, a film, a foil or an injection molding.

3. The molding as claimed in claim 1, wherein the organic matrix polymer that is compound material component A is polyethylene an ethylene copolymer, atactic, syndiotactic or isotactic polypropylene, a propylene copolymer, a polyamide, a copolyamide, a homopolyester, an aliphatic, cycloaliphatic or semi-aromatic copolyester, a modified polyester, polyvinylidene fluoride, a copolymer having vinylidene fluoride units, a thermoplastic elastomer, a cross-linkable thermoplastic polymer or copolymer, or a mixture or blend of two or more of the foregoing polymers.

4. The molding as claimed in claim 1, wherein the submicro- or nanoscale, electrically conductive additive that is compound material component B comprises submicro- or nanoscale particles, flakes, needles, tubes, platelets and/or spheroids.

5. The molding as claimed in claim 1, wherein the organic copolymer based on at least two different ethylenic monomers that is compound material component C is a block copolymer having at least two different polymer blocks, a random or grafted copolymer, where the compound material component C optionally additionally comprises amorphous polymers.

6. The molding as claimed in claim 1, wherein the phase-change material is a native or synthetic paraffin; a native or synthetic wax, a polyalkylene glycol, a native or synthetic fatty alcohol; a native or synthetic wax alcohol; a polyester alcohol, an ionic liquid or a mixture of two or more of the foregoing materials.

7. The molding as claimed in claim 1, wherein the phase-change material has a phase transition in the range from −42° C. to +150° C., which is associated with a reversible change of its volume.

8. The molding as claimed in claim 1, wherein the polymer composition comprises stabilizers, modifiers, dispersing agents and/or processing aids.

9. The molding as claimed in claim 1, wherein the melting point or melting range of the matrix polymer alone or in conjunction with processing aids and/or modifiers is within the range from 100° C. to 450° C.

10. The molding as claimed in claim 1, wherein the melting point or melting range of the phase-change material is below the melting range of the matrix polymer by at least 10° C.

11. The molding as claimed in claim 1, wherein the molding resistivity at a temperature of 24° C. is from 0.001 Ω·m to 3.0 Ω·m.

12. The molding as claimed in claim 1, wherein in the temperature range 24° C.≤T≤90° C. the molding temperature-dependent resistivity is ρ(T), where the ratio ρ(T)/ρ(24° C.) increases with increasing temperature T from 1 to a value of from 1.1 to 30.

13. The molding as claimed in claim 1, wherein in the temperature range 24° C.≤T≤90° C. the molding temperature-dependent resistivity is ρ(T), where the ratio ρ(T)/ρ(24° C.) increases with increasing temperature T from 1 to a value of from 1.1 to 2.1 and the average value of the increase gradient $[\rho(T+\Delta T)-\rho(T)]/[\rho(24°\ C.)\cdot\Delta T]$ in the increase range is from 0.1/° C. to 3.5/° C.

14. The molding as claimed in claim 1, wherein the molding has been crosslinked with the aid of a chemical crosslinking agent, via heating and/or via treatment with high-energy radiation.

15. A process for the production of a molding as claimed in claim 1 comprising processing the phase-change material that is compound material component D with the copolymer that is the compound material component C to give a masterbatch and then mixing the masterbatch with the other components.

16. The molding as claimed in claim 3, wherein the polyethylene is LDPE, LLDPE or HDPE, the polyamide is PA 6, PA 11 or PA 12, the copolyimide is PA 6.6, PA 6.66, PA 6.10 or PA 6.12; the cycloaliphatic or semi-aromatic copolyester is polyethylene terephthalate, polybutylene terephthalate or polytrimethylene terephthalate and the modified polyester is a glycol-modified polyethylene terephthalate.

17. The molding as claimed in claim 4, wherein the submicro- or nanoscale particles, flakes, needles, tubes, platelets and/or spheroids are (i) submicro- or nanoscale particles made of carbon black, graphite, expanded graphite or graphene; (ii) submicro- or nanoscale metal flakes or particles made of Ni, Ag, W, Mo, Au, Pt, Fe, Al, Cu, Ta, Zn, Co, Cr, Ti, Sn or an alloy or mixture thereof; (iii) electrically conductive polymers, (iv) single- or multiwall, open or closed, unfilled or filled carbon nanotubes, or metal-fined carbon nanotubes.

18. The molding as claimed in claim 5, wherein the block copolymer having at least two different polymer blocks is styrene-butadiene-styrene block copolymer, a styrene-isoprene-styrene block copolymer, a styrene-ethylene-propylene-styrene block copolymer, a styrene-poly(isoprene-butadiene)-styrene block copolymer or an ethylene-propylene-diene block copolymer; and the random or grafted copolymer is ethylene-vinyl acetate-vinyl alcohol copolymer, an ethylene-methyl acrylate-maleic anhydride copolymer, an ethylene-ethyl acrylate-maleic anhydride copolymer, an ethylene-propyl acrylate-maleic anhydride copolymer, an ethylene-butyl acrylate-maleic anhydride copolymer, an ethylene-(methyl, ethyl, propyl or butyl) acrylate-glycidyl methacrylate copolymer, an acrylic-butadiene-styrene graft copolymer, an ethylene-maleic anhydride copolymer, an ethylene-glycidyl methacrylate copolymer, an ethylene-vinyl acetate copolymer, an ethylene-vinyl alcohol copolymer, an ethylene-acrylate copolymer or a polyethylene graft copolymer or polypropylene graft copolymer, and the amorphous polymers are cycloolefin copolymers, polymethyl methacrylates, amorphous polypropylene, amorphous polyamide, amorphous polyester or polycarbonates.

19. The molding as claimed in claim 18, wherein the ethylene-acrylate copolymer is an ethylene-(methyl, ethyl, propyl or butyl acrylate) copolymer.

20. The molding as claimed in claim 6, wherein the synthetic wax is a highly crystalline polyethylene wax and the polyalkylene glycol is polyethylene glycol.

21. The molding as claimed in claim 10, wherein the melting point or melting range of the phase-change material is below the melting range of the matrix polymer by at least 20° C.

22. The molding as claimed in claim 10, wherein the melting point or melting range of the phase-change material is below the melting range of the matrix polymer by at least 30° C.

* * * * *